US009931004B2

(12) United States Patent
Göttler

(10) Patent No.: US 9,931,004 B2
(45) Date of Patent: Apr. 3, 2018

(54) HAND-HELD CLEANING DEVICE FOR SMOOTH SURFACES

(76) Inventor: Karl Göttler, Hohenaltheim (DE)

( * ) Notice: Subject to any disclaimer, the term of this patent is extended or adjusted under 35 U.S.C. 154(b) by 1209 days.

(21) Appl. No.: 14/003,190

(22) PCT Filed: Mar. 2, 2012

(86) PCT No.: PCT/EP2012/053599
§ 371 (c)(1),
(2), (4) Date: May 23, 2014

(87) PCT Pub. No.: WO2012/119933
PCT Pub. Date: Sep. 13, 2012

(65) Prior Publication Data

US 2014/0359961 A1 Dec. 11, 2014

(30) Foreign Application Priority Data

Mar. 7, 2011 (DE) ..... 10 2011 005 211

(51) Int. Cl.
*A47L 1/06* (2006.01)
*A47L 13/11* (2006.01)

(52) U.S. Cl.
CPC ..... *A47L 1/06* (2013.01); *A47L 13/11* (2013.01)

(58) Field of Classification Search
CPC ..... A47L 1/06; A47L 13/11
See application file for complete search history.

(56) References Cited

U.S. PATENT DOCUMENTS 5,347,676 A * 9/1994 Saitoh ..... A47L 13/11 15/121
2004/0211020 A1 10/2004 Varner
2007/0283520 A1* 12/2007 Vamer ..... A47L 1/06 15/245

FOREIGN PATENT DOCUMENTS

| | | | |
|---|---|---|---|
| DE | 224595 | A | 7/1909 |
| DE | 20117528 | U1 | 12/2002 |
| EP | 1287777 | A2 | 3/2003 |
| GB | 2300801 | A | 11/1996 |
| WO | 0061448 | A1 | 10/2000 |
| WO | 2003/061448 | A1 | 7/2003 |

OTHER PUBLICATIONS

Notification of Transmittal of Copies of Translation of the International Preliminary Report on Patentability dated Sep. 19, 2013.
International Search Report dated Jun. 15, 2012 corresponding to PCT/EP2012/053599.

(Continued)

*Primary Examiner* — Randall Chin
(74) *Attorney, Agent, or Firm* — Hogan Lovells US LLP

(57) ABSTRACT

The hand-held cleaning device, especially the hand-held cleaner for smooth surfaces, comprising a supporting unit, a wiper blade, a guiding device and a capture unit, wherein the wiper blade is fixed to the supporting unit, wherein the wiper blade at least in certain areas has a guiding element, which is designed for guiding fluid present at wiper blade in the direction of the guiding device, and wherein the guiding device is arranged adjacent to the wiper blade and is directly adjoining to the capture unit in order to transport the fluid from the wiper blade across the guiding element and the guiding device to the capture unit.

19 Claims, 4 Drawing Sheets

(56) References Cited

OTHER PUBLICATIONS

International Search Report and Written Opinion, PCT Application No. PCT/EP2012/053599, European Searching Authority, Search completed May 31, 2012, Authorized Officer Baumgartner, Ruth (Non English-Language).
International Search Report, PCT Application No. PCT/EP2012/053599, European Searching Authority, Search completed May 31, 2012, Authorized Officer Baumgartner, Ruth (English Language Translation).

* cited by examiner

HAND-HELD CLEANING DEVICE FOR SMOOTH SURFACES

This application is a 371 application of PCT/EP2012/053599, filed on Mar. 2, 2012. This application claims the benefit of DE Application Number 10 2011 005 211.9, which was filed on Mar. 7, 2011, the contents of which are herein incorporated in its entirety.

BACKGROUND

Field of the Invention

The present invention relates to a hand-held cleaner for cleaning smooth surfaces, especially window panes.

Related Art

The Hand-held cleaners in question are well known from prior art. Generally the approach thereof is to press a wiper blade of flexible material against e.g. a panel and to subsequently move it across the panel thereby stripping off fluids which are present on the panel in the movement direction. Specifically with vertically oriented panels the problem arises that the fluid which has been stripped off will flow along the hand-held cleaner or will, upon reaching a certain quantity, laterally pass it. Alternatively, use of a cleaning device of absorbent material truly avoids the effect of uncontrolled drain of the fluid to be removed from the smooth surface but high cleaning effectiveness and cleaning rate will not easily be obtained by the use of wiper blade.

It is thus an object of the present invention to provide a hand-held cleaner having the advantages of a cleaner with wiper blade but circumventing the problem of uncontrolled drain of fluid upon cleaning a smooth surface.

This object will be solved by a hand-held cleaner of the present invention. Preferred embodiments will become obvious from the dependent claims.

SUMMARY OF THE INVENTION

According to the invention the hand-held cleaner, especially the hand-held cleaner for smooth surfaces, comprises a supporting unit, a wiper blade, a guiding device and a capture unit, the wiper blade being fixed to the supporting unit, wherein the wiper blade has a guiding element at least in certain areas which is intended to guide fluid present on the wiper blade in the direction of the guiding device wherein the guiding device is arranged adjacent to the wiper blade and is directly adjoining to the capture unit, to transport the fluid from the wiper blade across the guiding element and the guiding device to the capture unit. The wiper blade, which according to the invention is fixed to the supporting unit during cleaning process, is forced against the smooth surface to be cleaned, wherein a fluid which is to be removed from that surface may be passed to the wiper blade. In the context essential herein a smooth surface, or a surface, respectively, shall preferably be characterized by a low surface roughness, such as for example window panes, polished or varnished surfaces or ceramic tiles. The smooth surface thereby may preferably be planar, such as for example a window pane, or may be curved, such as for example the wind shield or body parts of a vehicle. The fluid which adheres to the smooth surface and is to be removed therefrom preferably consists of the main components water, cleaning agent and soil. Preferably the wiper blade is moved along the smooth surface, wherein the fluid in the contact region between the wiper blade and surface will be impounded. That impounded fluid is preferably stripped off along the wiper blade, wherein the smooth surface is preferably already free of fluid after one run of the wiper blade. Across the wiper blade the fluid passes into a guiding device, which with one of its sides is arranged adjacent to and/or at least in certain areas opposite to the wiper blade and with the other side is directly adjoining to a capture unit. Preferably the guiding device has geometric features, such as for example edges and/or recesses favoring the fluid to drain off the wiper blade. The wiper blade has a guiding element for assisting guidance of the fluid, preferably preventing the fluid from being stripped off the wiper blade from another side than that of the guidance. Preferably the wiper blade has two or a plurality of guiding elements. In a preferred embodiment the guiding element(s) is/are integrally configured with the wiper blade In further advantageous embodiments projections and/or recesses may be provided on both the wiper blade and the guiding elements, each engaging in corresponding projections and/or recesses of the opposite element thus form-fittingly or force-fittingly connecting the guiding element and wiper blade to each other. Preferably the guiding element may be fixed to the wiper blade by way of an adhesion bond, generated for example by bonding or welding. In a preferred embodiment the wiper blade and the guiding element are made of the same material.

In a preferred embodiment a first end of the wiper blade is fixed to the supporting unit, a second end being provided, which is opposite to the first end, wherein the distance of the two ends from each other is the longitudinal extension of the wiper blade, and wherein at the second end of the wiper blade a transversal lip is provided, protruding from the wiper blade in the transversal direction to the longitudinal extension and essentially parallel to the edge of the second end. The supporting unit preferably is to hold the wiper blade and to guide it along the smooth surface. Preferably by supporting the wiper blade it will be secured against torsion and deflection in relation to the supporting unit, so that forces and momenta may be transmitted to the wiper blade by the supporting unit. It may for example be preferred to provide a clamping device at the supporting unit, in which one end of the wiper blade is fixed. In a further preferred embodiment the supporting unit may have a region with an undercut, into which a region with a projection on the wiper blade is inserted and subsequently will secure the wiper blade against deflection in the insertion direction. Furthermore recesses or bore holes may be provided on the wiper blade, wherein appropriate recesses will engage into the supporting unit generating a form-fit or force-fit. Opposite to the first fixed end of the wiper blade a second, preferably distal end, which is also free, is provided. Preferably the wiper blade may thereby have a rectangular form, wherein the edges of the two ends of the wiper blade preferably have the same length. It may be advantageous if the wiper blade has a trapezoidal shape, wherein preferably the distal end of the wiper blade has a longer edge than the fixed end to be able to strip off fluid from a larger surface in one run. The edges of the fixed end and the distal end are preferably aligned parallel to each other. The distance of the two ends from each other is defined as the longitudinal extension of the wiper blade. Most preferably the wiper blade at its distal end has a transversal lip which projects from the wiper blade transversally to the longitudinal extension and preferably projects parallel to the edge of the distal end. Preferably, transversally to its extension, the thickness of the transversal lip is lower than that of the wiper blade. One end of the transversal lip preferably is fixed to the wiper blade, the end of the transversal lip which is opposite thereto and which is free or distal, respectively, may preferably be made resting on the panel. The transversal lip may advantageously be made of the same material as the wiper blade and may be integral with the latter. Furthermore the transversal lip will preferably be fixed to the wiper blade by generating an adhesion bond, for example by way of bonding or welding, or by generating an adhesion bond, by way of suitable projections and recesses on the transversal lip and wiper blade. Preferably the transversal lip also extends into a second direction, planar-symmetrically to the plane, which is spanned by the longitudinal extension and the edge of the distal end of the wiper blade. The wiper blade with such a transversal lip extending in two directions has, in a simplified view, a t-shaped cross section. The planar-symmetrical configuration of the transversal lip in combination with guiding elements which are provided on both sides of the wiper blade and which are also planar-symmetrical to each other allows improving the contact pressure to the smooth surface of the transversal lip. Especially by way of specific distribution of material strength of the guiding elements along the longitudinal extension the bending stiffness of the combination of wiper blade and guiding elements preferably may be developed in a manner which is versatile along the longitudinal extension of the wiper blade and in this way for example, with variable contact pressure of the hand-held cleaning device to the smooth surface, the angle between the transversal lip and the smooth surface may be maintained in an advantageous range. In each of the preferred embodiments "transversal" is meant to be "perpendicular".

In an advantageous embodiment the transversal lip and/or the guiding element and/or the guiding device are arranged on that side of the wiper blade which faces the smooth surface. In order to configure the fluid guiding process from the transversal lip to the capture unit in a most reliable way preferably all supporting elements or devices, respectively, are provided on that side of the wiper blade, which during the cleaning process faces the smooth surface or which is directly adjoining to this side. It thus is assured that fluid which is absorbed via the distal end of the wiper blade itself, or preferably via the transversal lip, may flow along the wiper blade and may pass to the guiding device, promoted by the guiding element. The guiding device subsequently will guide the fluid to the capture unit.

Preferably the guiding element essentially extends along the longitudinal extension. In other words the guiding element has an extension, which along the longitudinal extension of the wiper blade, is longer than the extension in other directions and preferably is several times longer than the extension in other directions.

Preferably the guiding element in a certain region projects from the wiper blade to a lesser extent than the transversal lip, so that upon contacting the smooth surface, the transversal lip of the wiper blade will not be lifted from the smooth surface. Since both the transversal lip and the guiding element project from the wiper blade, preferably in the same direction, care must be taken, that upon deforming the wiper blade during the cleaning process, the transversal lip will not be lifted from the smooth surface or the contact pressure of the transversal lip to the smooth surface will not be reduced, respectively, by such an extent that in certain areas or across the entire length of the transversal lip a gap between the smooth surface and the transversal lip will arise. It will thus be preferred that the guiding elements in a region having the length x have a lower extension perpendicular to the longitudinal extension of the wiper blade than the transversal lip. Furthermore it may be advantageous, that between the fixed end of the wiper blade and about the half of the longitudinal extension thereof the guiding elements only project by about 1 mm from the wiper blade, wherein especially if there is very high contact pressure between the hand-held cleaning devices and the smooth surface optimal contact of the transversal lip to the smooth surface is furthermore assured.

Advantageously the ratio of the region x to the overall longitudinal extension of the wiper blade is between 0.2 and 0.9, preferably between 0.3 and 0.6 and especially preferably is 0.4.

In a further preferred embodiment the longitudinal extension of the wiper blade is several times the thickness of the wiper blade, wherein the ratio of the longitudinal extension to the thickness is preferably greater than 10, especially preferably 15 and most preferably about 17. Preferably the flexibly deformable material or the resilient material, respectively, of which the wiper blade is made, is a siloxane, wherein the transversal lip is forced to the smooth surface by way of a resilient force resulting from flexible deformation of the wiper blade. The relatively large longitudinal extension of the wiper blade has the advantageous effect, that upon differently bending the entire wiper blade the transversal lip is forced to the smooth surface with a relatively consistent force. By the use of that production material which is especially useful for flexible deformation angular modifications at the fixed end of the wiper blade will not directly affect the transversal lip or the position on the smooth surface, respectively. The large longitudinal extension of the wiper blade furthermore offers the opportunity, with a preferred trapezoidal shape of the wiper blade, to provide a distal end of the wiper blade the edge of which is considerably longer than the fixed end, without the risk of too heavy diversion of the fluid flow along the wiper blade and the risk of imminent lateral drain of the fluids. The large longitudinal extension of the wiper blade in this preferred embodiment allows the fluid flow along the wiper blade to be gradually narrowed from the large extension to the transversal lip or from the distal end to the smaller extension in front of the guiding device, respectively. As an advantage of the material siloxane for the production of the wiper blade the lubricating effect of this material shall be mentioned herein resulting in improved sliding of the wiper blade across the surface to be cleaned and thus in reduced exertion of force upon handling the hand-held cleaning device.

Advantageously an outlet port is provided on the capture unit or on the supporting unit, wherein the outlet port is preferably closable. In order for the fluid passing into the capture unit via the guiding device to be able to be easily discharged from the capture unit preferably one or more outlet ports, e.g. in the form of bore holes are provided in the capture unit. Especially preferably the outlet port is able to be closeably locked, for example by way of a screw-on top and an appropriate closure. It may furthermore be preferred that the capture unit is provided with a device which prevents the fluid from being able to escape in the direction of the wiper blade. Preferably this will for example be enabled by way of a plastic layer which is arranged as a valve which allows entering the capture unit which however will be closed in the counter direction in order to assure the collected fluid to solely escape via the outlet port from the capture unit. In an advantageous arrangement of at least two outlet ports at opposite sides of the capture unit, furthermore the opportunity arises to rinse the capture unit in order to therefrom remove for example residual soil and cleaning agents. Preferably the capture unit has a fluid level indicator which allows the filling level of the capture unit to be read from the exterior.

Especially preferably the outlet port is arranged such that it is located at the highest point of a collecting compartment which is surrounded by a capture unit and supporting unit, while forcing the hand-held cleaner against the smooth surface. This feature especially serves for fully utilizing the collecting compartment which is surrounded by the capture unit or the capture unit and the supporting unit, respectively, before overflow of the collected fluid, or the fluid via the outlet port, respectively, occurs.

Preferably the supporting unit and the capture unit are arranged directly adjoining to each other and are connected by fixing means. In this preferred embodiment the capture unit is placed directly adjoining to the supporting unit, wherein an especially compact configuration of the hand-held cleaning device will be obtained. It may be preferred that the compartment in which the fluid is collected is, on one side, limited by the supporting unit, wherein the supporting unit and capture unit are required to have an appropriate closure at their junction avoiding escape of fluid at the junction between the two elements. Preferably fixing means connect the capture unit and the supporting unit to each other, wherein for this especially preferably screws are to be used which engage in designated bore holes at the capture unit and supporting unit. Preferably projections and recesses may also be arranged on the capture unit and the supporting unit generating a form-fit upon engaging into each other thereby connecting the capture unit and the supporting unit to each other. Preferably the capture unit and the supporting unit may also be integrally formed, e.g. by way of a pressure casting process, wherein mounting expenses for the manufacture of the hand-held cleaning devices advantageously will be reduced.

It may furthermore be preferred that fluid present at the wiper blade will pass via an elongated guiding device into the capture unit, and wherein the capture unit is not directly arranged directly adjoining to the supporting unit. In this preferred embodiment the capture unit may be designed as a separate component, for example a reservoir, which is carried by the user of the hand-held cleaning devices on the back or which may be deposited, respectively. This external capture reservoir may preferably receive a large amount of fluid without increase of weight of the hand-held cleaning devices hampering the user. The hand-held cleaner according to the invention in this preferred embodiment is especially useful for cleaning large surfaces which are wetted by a large quantity of fluid. In order the fluid to be able to enter the capture unit an elongated guiding device will be required. This elongated guiding device preferably has a portion, for example tubing, through which the fluid may flow to the capture unit which is distant from supporting unit and the wiper blade. Preferably that elongated guiding device is at least in certain areas integrated in a handle which is to be securely supported by the supporting unit.

Preferably at the supporting unit a handle holder is provided, onto which a handle may be secured against deflection in relation to the supporting unit. The handle firstly serves for guiding the supporting unit and also for guiding the wiper blade secured thereto along the smooth surface. The handle holder preferably is integrally manufactured with the supporting unit and preferably has a thread, into which a thread provided on the handle will engage.

Advantageously a retaining bracket may pivotably be fixed to the supporting unit or the capture unit in order to keep the wiper blade forced against the smooth surface at a specified deflection in relation to the supporting unit. Especially in order to be able to nevertheless powerfully force a readily deformable wiper blade made of this production material of a low E-module against the smooth surface a retaining bracket is provided. The latter preferably is pivotably arranged wherein one, or preferably two stop pins limit pivoting movement thereof in a pivoting direction. Upon attaining this pivoting position the retaining bracket in turn limits a deflection of the wiper blade, which preferably abuts in a receiving region of the retaining bracket. Upon increasing the contact force onto the hand-held cleaner by the user the wiper blade now, in addition to its reset force, is also forced against the smooth surface by the reset force of the retaining bracket. Preferably the production material has a high E-module in order to be able, under minor further deformation, to transmit large forces to the distal end of the wiper blade or the transversal lip thereof.

Alternatively the retaining bracket may preferably also be fixed non-pivotably to the supporting unit or the capture unit, wherein the wiper blade upon attaining a specified deflection abuts against the receiving region of the retaining bracket and will be held or supported by the latter, respectively, as described above. Preferably in this case the retaining bracket is fixed to the supporting unit or the capture unit in a desired pivoting angle in relation to the rest position of the wiper blade.

The retaining bracket is pivotable about a pivoting angle $\alpha$ wherein a stop pin is provided limiting the pivoting movement of the retaining bracket in a pivoting direction, wherein the maximum pivoting angle $\alpha$ is in a range between 20° and 90°, preferably between 30° and 70° and most preferably at about 40° to 50°. Depending of the length or the longitudinal extension of the wiper blade, respectively, it may be preferred to solely allow specified pivoting angles and thus to solely allow specified deflections of the wiper blade. It has become obvious that those ranges of possible, maximum pivoting angles allow an especially easy adaption of the hand-held cleaning devices to specified surfaces, thickness and longitudinal extension of the wiper blade enabling the desired manual handling position of the user upon stripping a smooth surface.

Further advantages and feature will become obvious from the following explanatory description of a preferred embodiment of the hand-held cleaning device according to the invention referring to the accompanying figures, wherein different feature of different executive examples may be combined with each other within the scope of the invention, wherein

DETAILED DESCRIPTION

Figure 1:
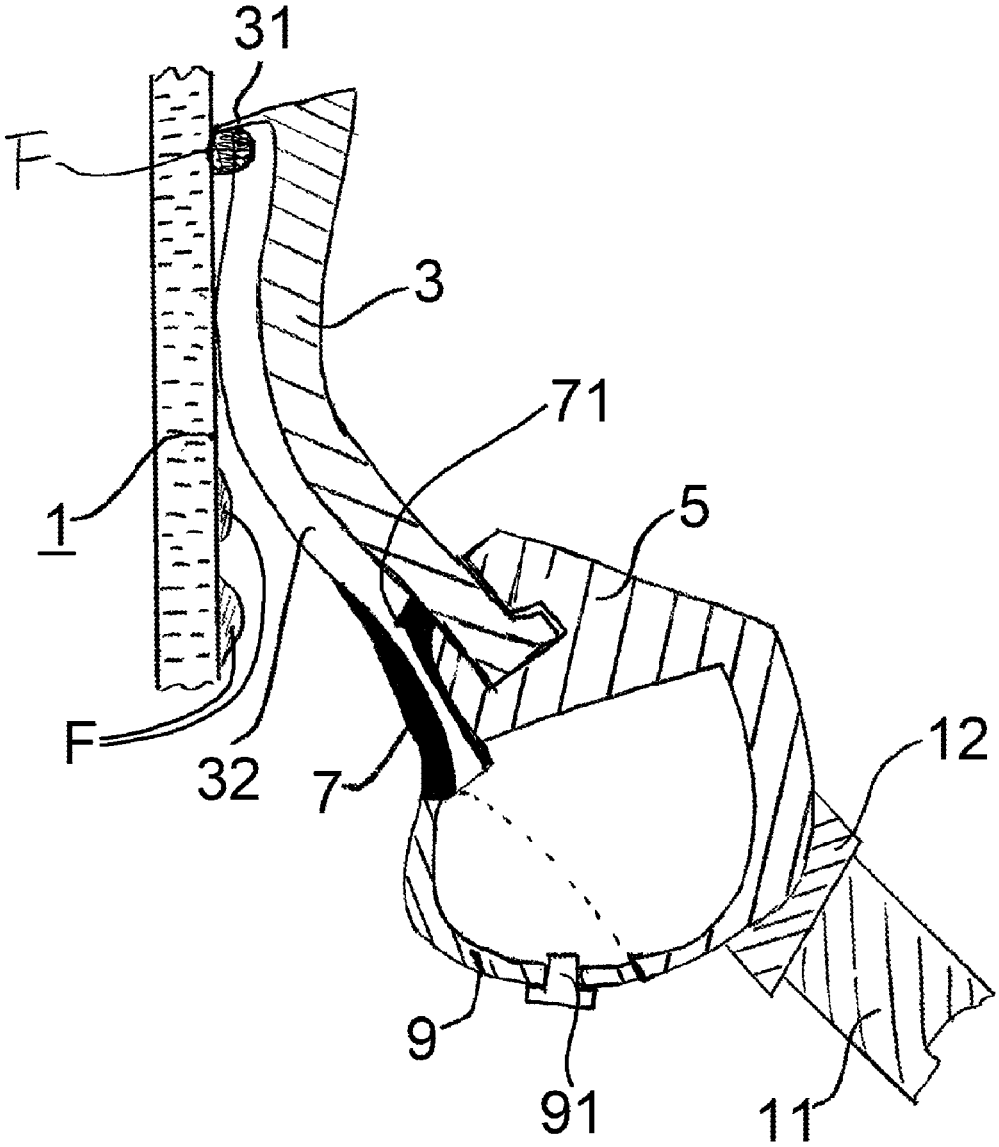
FIG. 1 is a sectional view of a preferred embodiment of the hand-held cleaning device according to the invention.

In a preferred embodiment the hand-held cleaner shown in FIG. 1 comprises a supporting unit 5, a wiper blade 3, a guiding device 7, a capture device 9, a handle 11 and a handle holder 12. The wiper blade 3 preferably has a transversal lip 31 and at least one guiding element 32, each extending toward the side where the guiding device 7 is supported directly adjoining to the wiper blade 3. In the figure the wiper blade 3 is shown in a deformed position, wherein the transversal lip 31 is forced against the smooth surface 1. Preferably the smooth surface 1, as shown in the figure, is the surface of a glass panel which is wetted by a fluid F. By striping the hand-held cleaning device along the glass panel the fluid F accumulates at the transversal lip 31 and flows, due to the adhesive effect, adhered to the surface of the wiper blade 3, along the wiper blade 3 to the guiding device 7. As depicted in the figure, at the guiding device there is preferably a protrusion or pedestal or shoulder 71 where the fluid F becomes separated from the wiper blade, thus flowing along the guiding device into the capture unit 9. In the preferred embodiment the compartment where the fluid F accumulates is formed both by the supporting unit 5 and the capture unit 9. In further preferred embodiments not shown in the figure the capture unit 9 may also be a closed tubular part, which for example is directly fixed to the supporting unit 5. In the preferred embodiment the wiper blade 3 is fixed to the supporting unit 5 by way of an adhesion bond, wherein the recess at the supporting unit 5 has an undercut, into which a recess at the wiper blade 3 form-fittingly engages, thus securing the wiper blade 3 against deflection and distortion in relation to the supporting unit 5. At the supporting unit 5 a handle holder 12 is furthermore provided, to which a handle 11 may be fixed.

Figure 2:
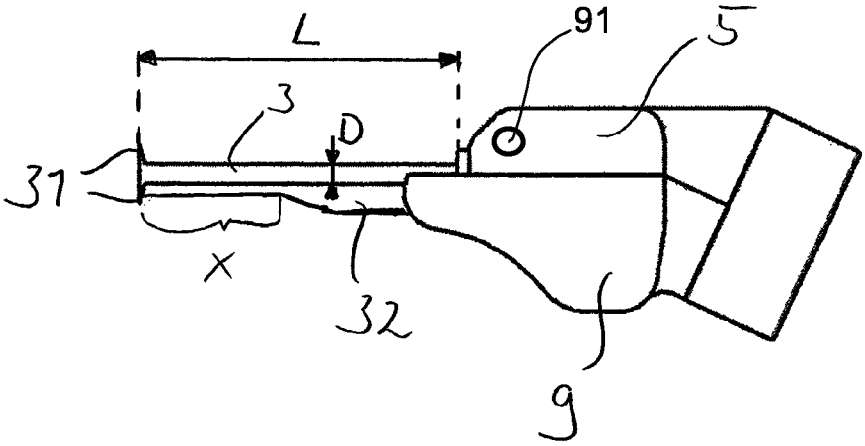
FIG. 2 is a lateral view of a preferred embodiment of the hand-held cleaning device according to the invention.

FIG. 2 shows as lateral view of a preferred embodiment of the hand-held cleaning device according to the invention, wherein, especially of the region x is marked, wherein the guiding element 32 preferably does not transversally protrude over from the wiper blade 3 further than the transversal lip 31 as shown in the figure. The longitudinal extension L of the wiper blade 3 is also shown, which extends from the fixed end of the wiper blade 3 to the free, loose or distal end, respectively. Furthermore the preferred embodiment is represented, wherein the transversal lip 31 extends in two directions perpendicular from the wiper blade 3, i.e. in FIG. 2 the figure both upwardly and downwardly. The thickness D of the wiper blade 3 is preferably several times smaller than the longitudinal extension L. Furthermore the configuration of the supporting unit 5 and the capture unit 9 may be seen in detail in the figure, which each are designed in the form of half-shell components and which are coupled to each other with fixing means which are not shown. In the capture unit 9 or the supporting unit 5 an outlet port 91 is introduced allowing emptying out the collection compartment formed by the capture unit 9, or the capture unit 9 and the supporting unit 5. It is of advantage if the outlet port 91 is preferably arranged at the supporting unit 5 in the upper half of the collection compartment or close to the fixing region of the wiper blade 3, respectively. It is especially preferable if the hand-held cleaner is employed and the wiper blade 3 obliquely projects from the hand-held cleaner in an upward direction, as it is shown in FIG. 1, the outlet port 91 is arranged close to the highest point of the collection compartment, in order to make the best use of the collecting compartment until overflow or drain, respectively, of fluid through the outlet port occurs and in order to be able to accommodate maximum amount of fluid.

Figure 3:
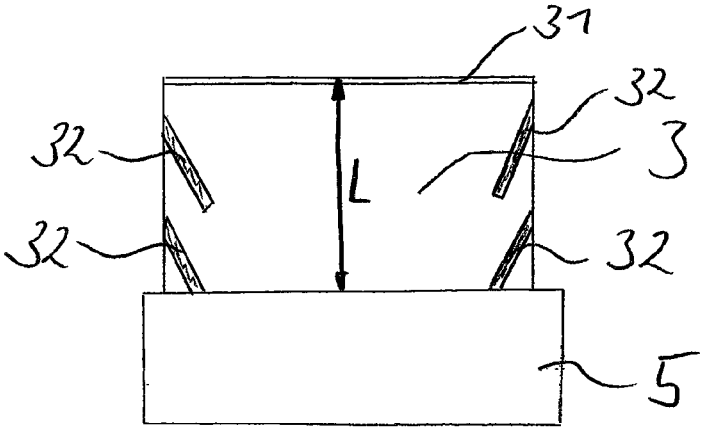
FIG. 3-5 are views of three preferred embodiments of the guiding elements according to the invention.
Figure 4:
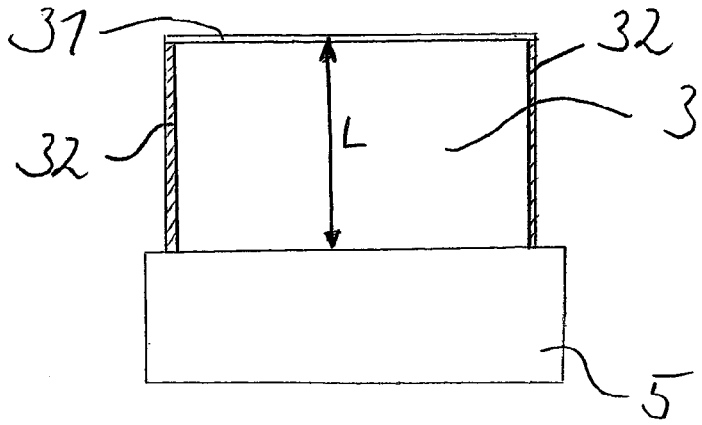
Figure 5:
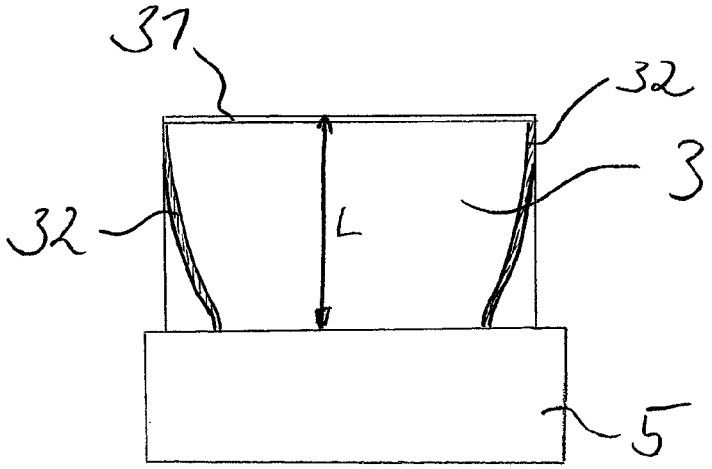

In the FIGS. 3 to 5 views of preferred embodiments of the guiding elements 32 are shown. Preferably two or more guiding elements 32 are arranged at the respective bottom side of the wiper blade 3, the guiding elements promoting guidance of the fluid from the transversal lip 31 to the supporting unit 5 of the guiding device 7 which is not shown. In the embodiment shown in FIG. 4 each of the guiding elements 32 function as bars limiting the wiper blade 3 and extending along the lateral edge of the wiper blade 3. In a preferred modification of the guiding elements 32, which is shown in FIG. 5, reduction of the width which is wetted by the fluid F at the wiper blade 3 allows the guiding device 7 to be designed smaller than the wiper blade 3. Similar to the course of the guiding elements 32 in FIG. 5, in an embodiment not shown, the lateral edges of the wiper blade 3 may be provided, wherein the loose end with the transversal lip 31 has greater edge length than the end which is fixed to the supporting unit 5.

Figure 6:
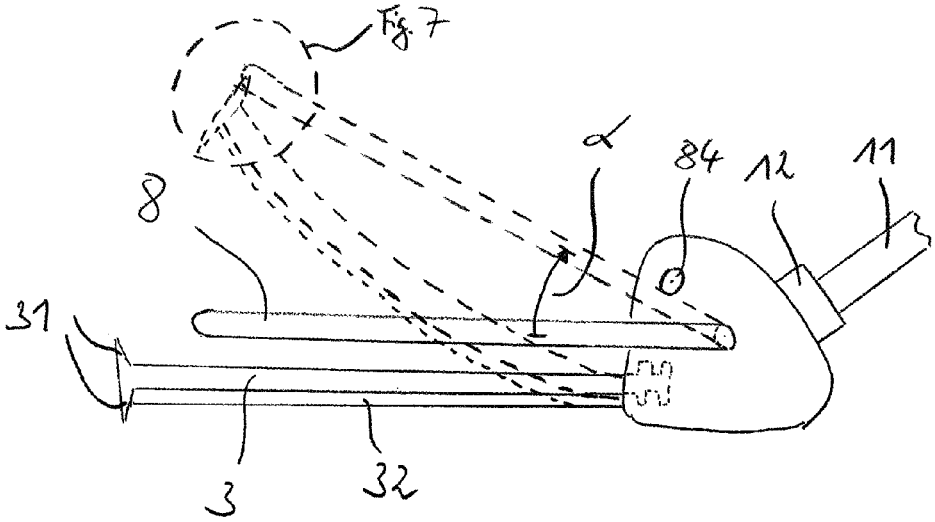
FIG. 6 is a lateral view of a preferred embodiment of the hand-held cleaning device with a retaining bracket.

FIG. 6 shows an embodiment, wherein the hand-held cleaner in addition to the features shown in the FIGS. 1 to 5 has a retaining bracket 8. The retaining bracket 8 preferably is pivotably fixed to the supporting unit 5 or the capture unit 9 via a pivoting bolt 82, wherein a stop pin 84 is provided which limits the pivoting movement of the retaining brackets 8 in one direction. In a first position, which is also to be referred to as rest position of the retaining bracket 8 and which in the figure is shown by a solid line, the retaining bracket 8 is arranged parallel to the wiper blade 3 which is not bent, or slightly rests on the latter (not shown). If the wiper blade 3 is forced to a smooth surface 1 it will be deformed thereby pivoting the retaining bracket 8 about a pivoting angle $\alpha$, as it is shown in the figure by a dashed line. This pivoting movement will only be allowed up to a pivoting angle $\alpha_{max}$, at which the retaining bracket 8 abuts against the stop pin 84. If upon reaching this maximum pivoting angle the contact force to the hand-held cleaner will further be increased the retaining bracket 8 now will receive this additional force forcing the distal end of the wiper blade 3 or the transversal lip 31 against the smooth surface 1 by way of this additional force. Advantageously higher contact pressure may be accomplished by way of the retaining bracket 8, than it would be possible solely by way of the reset force of the flexibly deformed wiper blade 3. In order to favor this effect the retaining bracket 8 preferably is made of a relatively stiff material, such as metal or duroplast. Preferably the stop pin 84 is formed as a hollow body and is arranged concentrically or coaxially, respectively, to the outlet port 91, wherein fluid flowing through the outlet port 91 passes the stop pin 84 and exits to the exterior.

Figure 7:
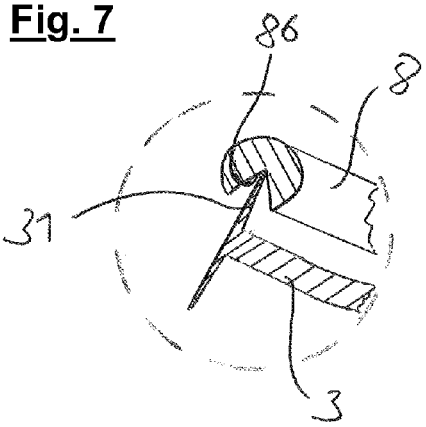
FIG. 7 is a detailed view of the hand-held cleaning device of FIG. 6.
Figure 8:
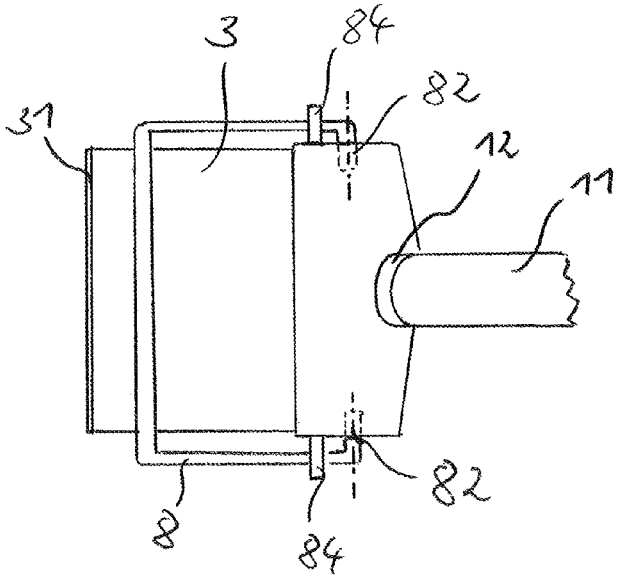
FIG. 8 is a top view of the hand-held cleaning device of FIG. 6.

FIG. 7 is a sectional view showing the detailed view of the front part of the retaining bracket 8 engaging the wiper blade 3, as already set forth in FIG. 6. Preferably the retaining bracket 8 has a receiving portion 86 in that region, where, in its maximum deflection—at $\alpha_{max}$—it engages the wiper blade 3 or the transversal lip 31 of the wiper blade 3. The receiving portion 86 especially functions for accommodating the wiper blade 3 or the transversal lip 31, respectively, and for this purpose is preferably formed as a recess into which the wiper blade 3 or the transversal lip 31, respectively, may engage. A cross section which at least in certain areas coincides with the wiper blade 3 or the transversal lip 31, such as for example of the V-shaped cross section, is especially preferred. The receiving region 86 especially prevents the distal end of the wiper blade 3 or the transversal lip 31, respectively, from being shifted out of place along the retaining bracket 8 under heavy contact pressure exerted by the hand-held cleaning device against the smooth surface 1 and no longer will contact the smooth surface FIG. 8 shows a top view of the configuration shown in FIG. 6. It may initially be seen that the pivoting bolts 82 are preferably formed integrally with the retaining bracket 8 and engage into recesses on the hand-held cleaner. The gaps between the pivoting bolts 82 and the recesses are preferably tightly sealed to prevent unwanted escape of fluid.

LIST OF REFERENCE NUMBERS

1—smooth surface
3—wiper blade
31—transversal lip
32—guiding element
5—supporting unit
7—guiding device
8—retaining bracket
82—pivoting bolt
84—stop pin
86—receiving region
9—capture unit
91—outlet port
11—handle
12—handle holder
D—thickness of wiper blade
F—fluid
L—longitudinal extension of wiper blade
x—region
α—pivoting angle

The invention claimed is:

1. A hand-held cleaner comprising
a supporting unit (5),
a wiper blade (3),
a guiding device (7)
and a capture unit (9),
wherein the wiper blade (3) is fixed to the supporting unit (5),
wherein the wiper blade (3) at least in certain areas has a guiding element (32) which is designed for guiding a fluid (F) present at the wiper blade (3) in the direction of the guiding device (7),
wherein the guiding device (7) is arranged adjacent to the wiper blade (3) and is adjoining to the capture unit (9) in order to transport the fluid (F) from the wiper blade (3) across the guiding element (32) and the guiding device (7) to the capture unit (9), and
wherein the wiper blade (3) and the guiding element (32) are adhesively bonded to each other, and the wiper blade (3) and the guiding element (32) are made of the same material.

2. The hand-held cleaner according to claim 1, wherein a first end of the wiper blade (3) is fixed to the supporting unit, wherein a second end is provided, which is opposite to the first end, wherein the distance of the two ends from each other is the longitudinal extension (L) of the wiper blade, and wherein at the second end of the wiper blade a transversal lip (31) is provided, which essentially projects from the wiper blade (3) transversally to the longitudinal extension (L) and parallel to the edge of the second end.

3. The hand-held cleaner according to claim 2, wherein the transversal lip (31) and/or the guiding element (32) and/or the guiding device (7) is/are arranged at the side of the wiper blade (3) facing the smooth surface (1).

4. The hand-held cleaner according to claim 2, wherein the guiding element (32) in a region (x) projects from the wiper blade (3) to a lesser extent than the transversal lip (31) such that upon resting on the smooth surface (1), the transversal lip (31) of the wiper blade (3) will not be lifted from the smooth surface (1).

5. The hand-held cleaner according to claim 4, wherein the ratio of the region (x) to the longitudinal extension (L) is 0.2 to 0.9.

6. The hand-held cleaner according to claim 5, wherein the ratio of the region (x) to the longitudinal extension (L) is around 0.4.

7. The hand-held cleaner according to claim 2, wherein the longitudinal extension (L) of the wiper blade (3) is several times the thickness (D) of the wiper blade (3), wherein the ratio of the longitudinal extension (L) to the thickness (D) is greater than 10.

8. The hand-held cleaner according to claim 7, wherein the ratio of the longitudinal extension (L) to the thickness (D) is greater than 15.

9. The hand-held cleaner according to claim 7, wherein the ratio of the longitudinal extension (L) to the thickness (D) is about 17.

10. The hand-held cleaner according to claim 1, wherein the guiding element (32) essentially extends along the longitudinal extension (L).

11. The hand-held cleaner according to claim 1, wherein an outlet port (91) is provided at the capture unit (9) or the supporting unit (5), and wherein the outlet port (91) is closable.

12. The hand-held cleaner according to claim 11, wherein the outlet port (91) is arranged such that while the hand-held cleaner is oriented against a smooth surface (1) the outlet port (91) is located at the highest point of a collection compartment which is surrounded by the capture unit (9) and the supporting unit (5).

13. The hand-held cleaner according to claim 1, wherein the supporting unit (5) and the capture unit (9) are arranged directly adjoining to each other and are connected by way of fixing means.

14. The hand-held cleaner according to claim 1, wherein fluid (F) present at the wiper blade (3) will pass to the capture unit (9) via the guiding device (7), and wherein the capture unit (9) is not arranged directly adjoining to the supporting unit (5).

15. The hand-held cleaner according to claim 1, wherein a handle holder (12) onto which a handle (11) is secured against deflection in relation to the supporting unit (5) is provided at the supporting unit (5).

16. The hand-held cleaner according to claim 1, wherein a retaining bracket (8) is pivotably fixed to the supporting unit (5) or the capture unit (9), in order to keep the wiper blade (3) forced against a smooth surface (1) at a specified deflection in relation to the supporting unit (5).

17. The hand-held cleaner according to claim 16, wherein the retaining bracket (8) is pivotable about a pivoting angle (α), wherein a stop pin (84) is provided, which limits the pivoting movement of the retaining bracket (8) in a pivoting direction, and wherein the maximum pivoting angle (α) ranges between 20° and 90°.

18. The hand-held cleaner according to claim 17, wherein the maximum pivoting angle (α) ranges between 30° and 70°.

19. The hand-held cleaner according to claim 17, wherein the maximum pivoting angle (α) ranges between 40° and 50°.

* * * * *